US005253494A

United States Patent [19]

Frucco et al.

[11] Patent Number: 5,253,494

[45] Date of Patent: Oct. 19, 1993

[54] ARRANGEMENT FOR CONTROLLING DETERGENT ADDITION IN WASHING MACHINES

[75] Inventors: Giuseppe Frucco; Fernando Russo, both of Pordenone, Italy

[73] Assignee: Zanussi Elettrodomestici S.P.A., Italy

[21] Appl. No.: 832,427

[22] Filed: Feb. 7, 1992

[30] Foreign Application Priority Data

Feb. 27, 1991 [IT] Italy ..... 000012 A/91

[51] Int. Cl.[5] ..... D06F 39/02

[52] U.S. Cl. ..... 68/12.18; 68/17 R

[58] Field of Search ..... 68/12.18, 17 R; 134/57 D, 99.2; 222/651, 652

[56] References Cited

U.S. PATENT DOCUMENTS 3,124,271 3/1964 Beck et al. ..... 68/17 R X
4,960,139 10/1990 Rizzetto ..... 68/17 R X

FOREIGN PATENT DOCUMENTS 0093997 11/1983 European Pat. Off. ..... 68/17 R
0094034 11/1983 European Pat. Off. ..... 68/17 R
2062015 5/1981 United Kingdom ..... 68/17 R
2104109 3/1983 United Kingdom ..... 68/17 R

*Primary Examiner*—Philip R. Coe
*Attorney, Agent, or Firm*—Pearne, Gordon, McCoy & Granger

[57] ABSTRACT

A controller is associated with the detergent dispenser of a washing machine, such as a clothes washing machine or a combined clothes washing and drying machine. The controller selectively controls the addition of various detergents and rinsing aids into the machine's tub. The corresponding control position is signalled by a plurality of micro-switches (17, 18, 19, 20) that are actuated by a rotating compartment selector (15) of the dispenser. The selector selectively establishes communication between the cold or hot water supply and each one of the compartments of said dispenser. The micro-switches (17, 18, 19, 20) can be switched on or off, along with a corresponding operational component part (42, 43, 44, 45) of the machine, by the rotating compartment selector means (15). The closure of the micro-switches is reported to the electronic microprocessor controller (40) which therefore will identify the control position of the rotating compartment selector (15) and, as a consequence, the corresponding phase of the washing cycle being performed.

3 Claims, 2 Drawing Sheets

ARRANGEMENT FOR CONTROLLING DETERGENT ADDITION IN WASHING MACHINES

BACKGROUND OF THE INVENTION

The invention relates to a control arrangement for washing machines, in particular clothes washing machines or combined clothes washing and drying machines, said control arrangement being associated with the detergent dispensing means of the washing machine and adapted to selectively control the addition into the machine's tub of the various detergent products provided for pre-washing and washing the clothes, while at the same time automatically signalling the corresponding control position of the dispenser.

Detergent dispensers for washing machines such as clothes washing machines and/or combined clothes washing and drying machines are known in the prior art, which are divided into a number of separate compartments intended for holding the various pre-wash and main wash detergents, as well as the various rinsing aids such as the bleaching agent and/or the fabric conditioner, wherein each such compartment is capable of being selectively flushed by the water flowing in from the supply mains and directed into said compartment by means a suitable rotating compartment selector means, which is capable of being displaced into its various operational positions by suitable linkage means operable by one or several profiled cams of the program-sequence/timer control of the washing machine to thereby cause the water to flow into the wash tub of the machine together with the detergent or rinse aid contained in the compartment being from time to time flushed.

Detergent dispensers are also known from the prior art, which are intended for use in combination with electronic washing machines provided with microprocessor means to control each single washing process in all its various phases, wherein the compartments of the detergent dispenser are designed so as to be capable of being flushed with the in-flowing water through respective conduits individually controlled by shut-off devices such as electromagnetic shut-off valves or the like, each one of said shut-off devices being associated with the microprocessor control circuit so as to cause, when energized by the microprocessor, the in-flowing water to flush the compartment associated with said electrically actuated shut-off device and flow into the washing machine tub together with the detergent contained therein.

Further known types of detergent dispensers for use in combination with electronic washing machines provided with microprocessor control means and rotating compartment selector means of the aforementioned type, also comprise two plungers connected with the rotating compartment selector means so as to displace it into its various control positions, each one of said plungers containing wax capable of being heated by a PTC thermistor element to be electrically supplied through such a solid-state semiconductor switching device as a triac or the like which is included in the electric circuitry of said washing machines together with said microprocessor control means. In such a way, the rotating compartment selector means of said detergent dispensers is displaced into its various control positions through the control action of the microprocessor means, thereby causing the detergent or rinsing aid contained in the corresponding compartment to be flushed off into the wash tub by keeping both said PTC thermistor elements either energized or de-energized, or selectively energized and de-energized, through said solid-state triac switch, owing to the different thermal expansion of the wax in the two aforementioned plungers as brought about by said energization and de-energization processes of said PTC thermistor elements.

SUMMARY OF THE INVENTION

It is the purpose of the present invention to provide a control arrangement associated with a detergent dispenser for a washing machine, said control arrangement being organized so as to enable the control position of the rotating compartment selector means for conveying the in-flowing water into the various compartments of the dispenser to be instantaneously identified, in view of further improving the effectiveness with which each washing process selected in a washing machine provided with microprocessor control means can be actually carried out by accurately monitoring each functional and operational condition of the machine and eliminating in this way the drawback typically resulting in connection with the above described detergent dispensers of current design, which are not capable of ensuring said monitoring function of the washing machines in which they are installed.

Furthermore, the control arrangement according to the invention also enables, for each control position of said rotating compartment selector means, one or more operational components in the machine circuitry to be energized or switched on when individual phases of the selected washing process are being carried out, thereby enabling the electric circuitry of the machine to be simplified and rationalized and its functionality and performance to be at the same time enhanced, a condition which cannot be achieved in washing machines making use of the afore-described detergent dispensing systems.

BRIEF DESCRIPTION OF THE DRAWINGS

The control arrangement according to the invention is implemented with the construction characteristics as essentially set forth and described in the appended claims. The invention will be hereinafter further described by way of non-limiting example for better understanding, with reference to the accompanying drawings in which:

DETAILED DESCRIPTION OF THE PREFERRED EMBODIMENTS

Figure 1:
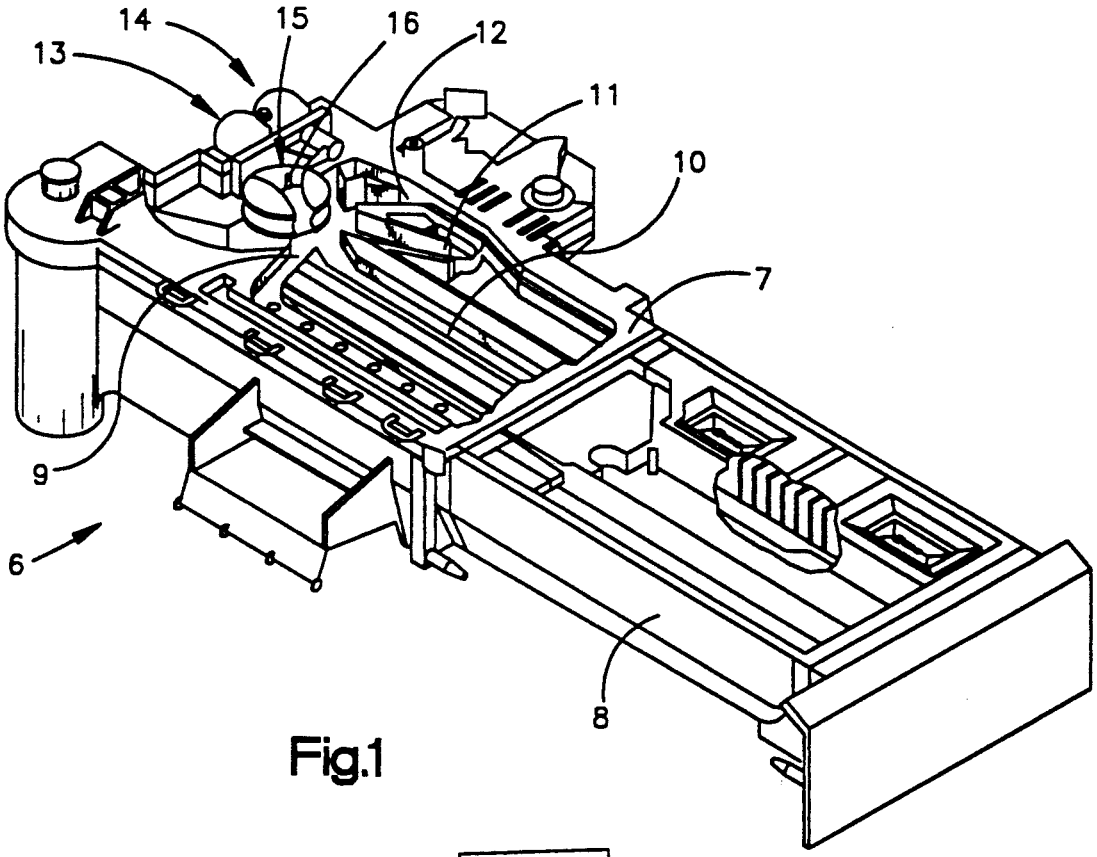
FIG. 1 is a perspective view of a section of a detergent dispenser for washing machines associated with the control arrangement according to the invention.

FIG. 1 schematically shows a detergent dispenser 6 which is installed in the usual way in the upper portion of a washing machine, and particularly of a drum-type clothes washing machine or combined clothes washing and drying machine, and is constituted by a flat conveying plate member 7 and a drawer-like reservoir 8 provided with a plurality of separate compartments intended to contain the various washing detergents and/or rinsing aids to be added in a selective manner into the wash tub of the washing machine where they will be used for carrying out the various steps and phases of each selected clothes washing process, said drawer-like reservoir 8 being slidingly insertable in a recess that is specially formed in the front portion of each washing machine, just below said flat conveying plate member 7. As it can further be seen, separate conduits 9, 10, 11 and 12 are formed internally in said flat conveying plate member 7, said separate conduits in said flat conveying plate member 7 mutually communicating with the corresponding compartments of the drawer-like reservoir 8 located below and being further supplied in a selective manner with the cold and/or hot water flowing in from the conduits 13 and 14, respectively, which are formed in the rear portion of said flat conveying plate member 7 and connected with a respective electromagnetic water inlet valve (not shown) of the washing machine through a rotating compartment selector means 15 that is arranged between said conduits 13 and 14 and said conduits 9, 10, 11 and 12 and is provided with at least one pass-through conduit 16 which is appropriately shaped so as to selectively connect either the conduit 13 or the conduit 14 with each one of the conduits 9, 10, 11 or 12.

Figure 2:
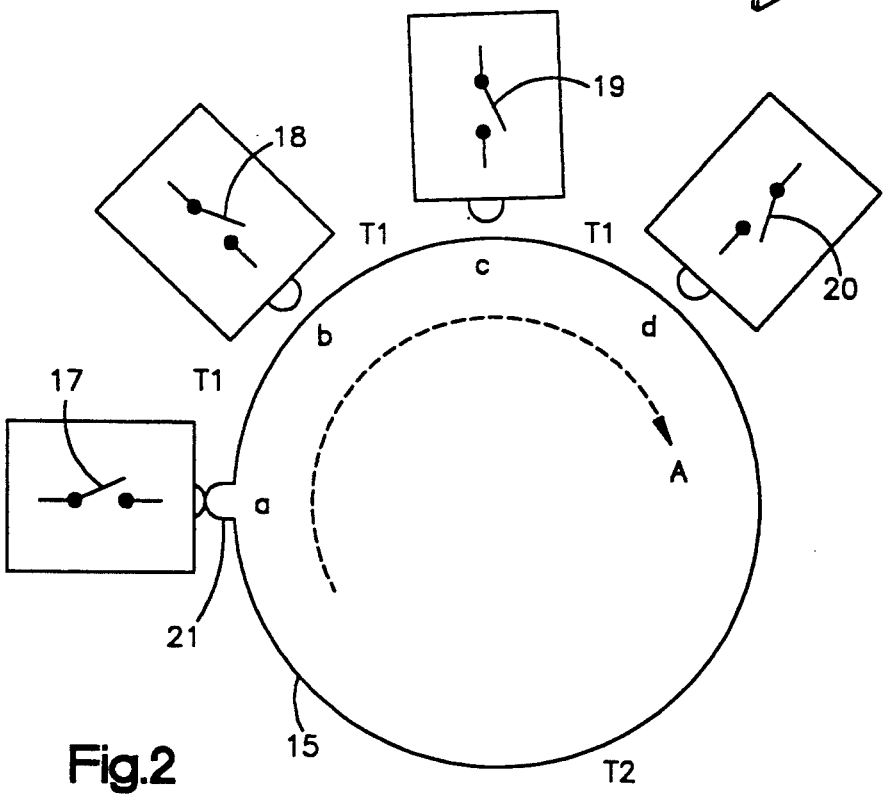
FIGS. 2 and 3 are a plan view of two different embodiments of a constructional detail of the detergent dispenser of FIG. 1 provided with the control arrangement according to the invention.

Said rotating compartment selector 15 is in particular displaceable into its various control positions (in this case, into the four distinct control positions as identified with the letters a, b, c and d in FIG. 2) by means of a linkage which is operable either by a synchronous electric motor associated with the above described detergent dispenser or by one or more profiled cams of a program sequence/timer control device of the washing machine (none of these component parts of the machine is shown in the figures).

Figure 3:
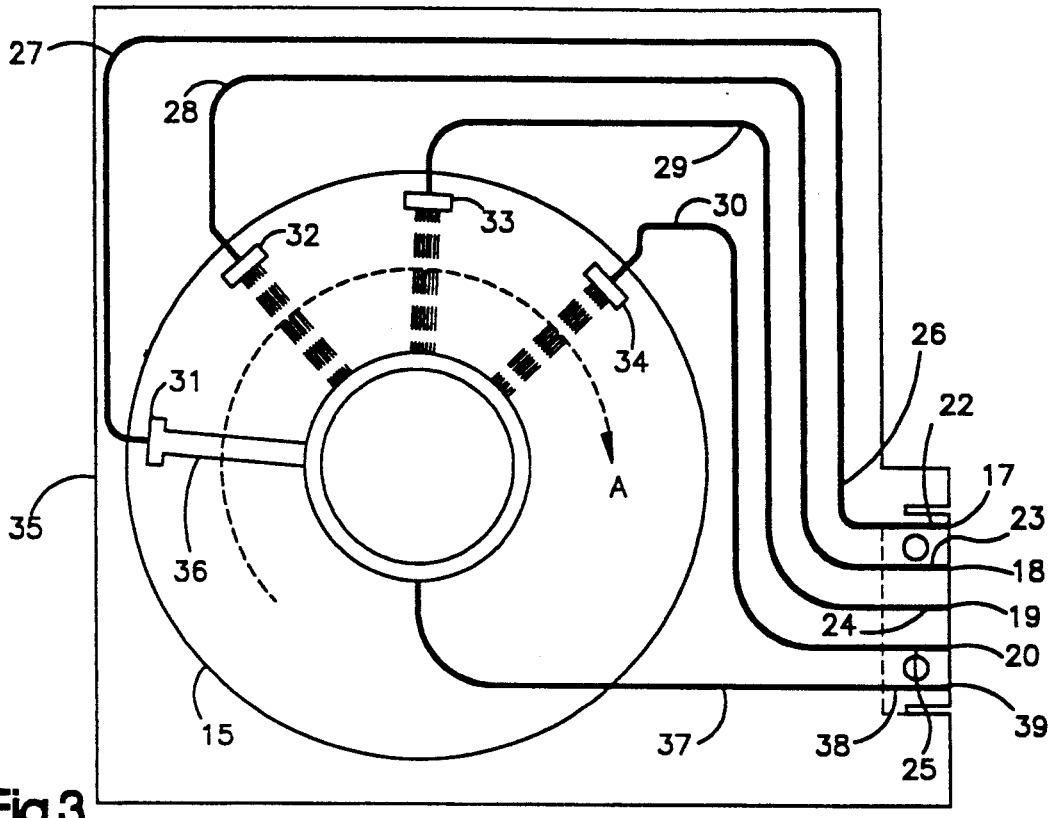

With particular reference to FIGS. 2 and 3, it can be seen that the control arrangement according to the invention, which is associated with the detergent dispenser made in the above described way, is essentially constituted by a plurality of micro-switches or similar electrical switching means operatingly included in the electrical circuitry of the washing machine in the way as described hereinafter, said means comprising in this case the micro-switches 17, 18, 19 and 20 adapted to detect the respective control positions a, b, c and d of the rotating compartment selector means 15 identifying the process phase being carried out by the machine in any particular moment during the washing program selected by the user.

In FIG. 2 it can be seen that the above cited micro-switches are physically arranged close to the rotating compartment selector means 15, so as to be capable of being operated from their normally open condition to their closed state by a prong 21 or similar protruding part that is integral with said rotating compartment selector means 15 and displaceable therewith as it rotates to move into its various control positions.

The control arrangement achieved in the above described way is therefore capable of automatically and instantaneously identifying, depending on which micro-switch is from time to time actuated and caused to close by the prong 21 during the rotation of said rotating compartment selector means 15, the control position of said rotating compartment selector means 15, said control position actually corresponding to a definite phase of the washing process being carried through by the machine. Such identification process is carried out by said control arrangement in the way that is described hereinafter.

Referring now to FIG. 3, it can further be noticed that said micro-switches are connected to respective electrical terminals 22, 23, 24 and 25 located on a terminal board 26 that is separated from and placed out of the way of said rotating compartment selector means 15, said terminals being connected through electrical conductor means 27, 28, 29 and 30, that are separated from each other and can in an advantageous way be obtained in the form of conductive tracks of a printed-circuit board, or printed-wiring strips, to corresponding fixed electrical contacts 31, 32, 33 and 34 being circular in their shape, which are located in a circular arrangement at angularly spaced positions corresponding to respective control positions of the rotating compartment selector means 15, on an electrically insulating plate 35 located underneath said rotating compartment selector means 15, which is in turn provided with a wiping contact 36.

Furthermore, said insulating plate 35 is connected through an electrical conductor means 37, which is also achieved in a most advantageous way in the form of a conductive track, or printed-wiring strip, on the aforementioned printed-circuit board, to another terminal 38 of the terminal board 26, said terminal 38 being in turn connected through another electrical conductor means 39 to a power supply source of the washing machine.

In this way, during the rotation of said rotating compartment selector means 15, the free end of the wiping contact 36 is from time to time displaced between each one of said fixed contacts 31–34, which connote the various corresponding control positions of said rotating compartment selector means, and the electrical conductor means 37, thereby from time to time closing in turn each one of the electrical circuits formed by said micro-switches 17–20, said electrical conductor means 27–30, the wiping contact 36 and the electrical conductor means 37 and 39, each micro-switch being closed by the action of said rotating compartment selector means being therefore capable of being instantaneously and automatically identified by the control arrangement provided according to the invention, as it will be further described in the following, to thereby indicate the corresponding control position taken by said rotating compartment selector means 15.

It will of course be appreciated that it is also possible to let the actuation of said micro-switches 17–20 be determined and carried out by the rotation of said rotating compartment selector means 15 through different embodiments of the arrangements illustrated to this purpose by mere way of example in FIGS. 2 and 3, so as to ensure in any case a correct identification of each one of the different control positions of said rotating compartment selector means in the desired way, without departing from the scope of the invention.

Figure 4:
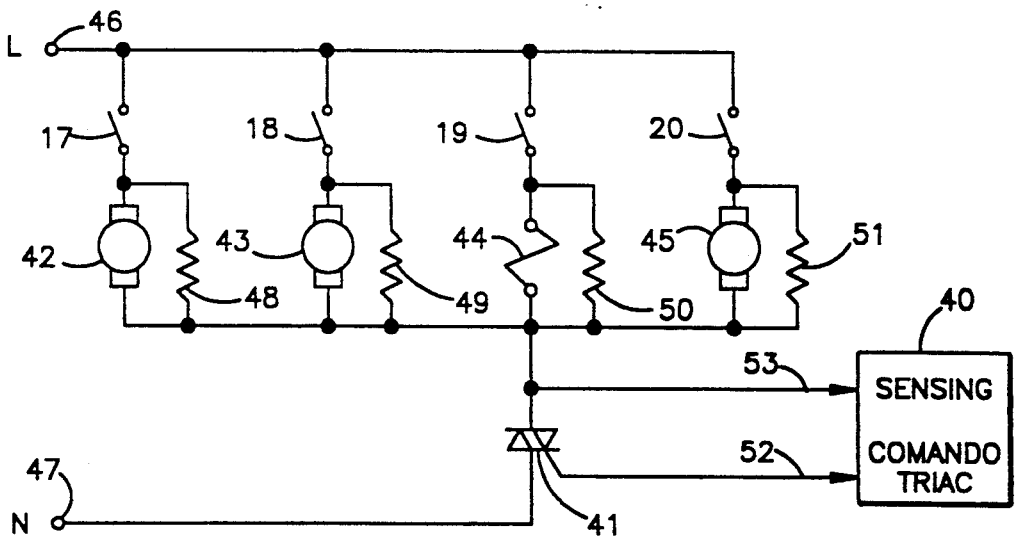
FIG. 4 is the electrical wiring diagram of the control arrangement according to the invention.

Referring now to FIG. 4, it can be seen that this illustrates the electrical wiring diagram of the control arrangement according to the invention. As it may be inferred from this figure, the considered control arrangement, apart from the micro-switches 17–20 that are operated the rotating compartment selector means 15 in the afore-described way, essentially comprises also the electronic microprocessor means 40 controlling the carrying out of the various operational cycles of the washing machine, as well as a solid-state semiconductor switching means such as a triac 41 or similar bidirectionally conductive switching device.

In particular, each one of the aforementioned micro-switches is connected in series with at least one of the various operational component parts of the washing machine and each series-circuit resulting therefrom is in turn connected in parallel with the remaining series-circuits of the same kind.

In the example considered, the micro-switches 17–20 are respectively connected in series with the drain pump 42, with the recirculation pump 43 which is connected with the recirculation conduit (not shown) of the washing machine provided to enable clothes to be washed through repeatedly recirculated wash liquor to be sprayed from above onto the clothes in the rotating drum of the washing machine, as well as with the electromagnetic valve 44 provided to control the inlet of hot water in the tub, and a specially provided detergent metering pump 45 associated with the detergent dispenser to withdraw the liquid detergent contained in a reservoir (not shown) appropriately provided and situated in the washing machine.

As it has already been mentioned above, all of these series-circuits are further connected in parallel with each other and are energized through a phase electrical conductor means 46, which is in turn connected with all of said micro-switches 17–20, and a neutral electrical conductor means 47, which is connected to a terminal of all above cited operational component parts of the washing machines, upon the interposition of the triac 41 or similar switching element.

Furthermore, the afore-cited operational component parts 42–45 of the washing machine are connected in parallel with at least a resistive element having a high ohmic rating (these elements are referred to with the respective numerals 48, 49, 50 and 51 in the figure) for the reasons that will be further explained.

Said microprocessor means 40 is in turn operationally connected with said triac 41 through a respective electrical conductor means 52 and is further directly connected through a further electrical conductor means 53 also with the same afore described terminal of all operational component parts 42–45 of the washing machine.

In this way, said electronic microprocessor means 40 is capable of performing a twofold function by driving through the triac 41 both the operational component parts 42–45, which are selectively energized by the corresponding micro-switches 17–20 when closing owing to the afore-described action of the rotating compartment selector means 15, and the remaining operational component parts (not shown) of the washing machine connected therewith, and by instantaneously and automatically recognizing the control position of said rotating compartment selector means 15, and therefore identifying the corresponding phase of the washing process being performed by the washing machine in that moment, owing to the detection performed through the electrical conductor means 53 of the micro-switch being from time to time caused to close in the afore-described way by the action of said rotating compartment selector means 15.

In particular, in order to displace said rotating compartment selector means 15 into each one of its various control positions, the electronic microprocessor means 40 acts to first of all switch off the triac 41 and then energize the synchronous motor or the program sequence/timer control device driving said rotating compartment selector means, so that the latter is rotatably driven to advance to its immediately next control position under resulting closure of the corresponding micro-switch and energization of the operational component part of the machine which is associated with that micro-switch, and said microprocessor means 40 acts then to energize the series-circuit of said micro-switch and said operational component part by causing the triac 41 to be triggered, i.e., switched on again and enabling in this way the corresponding phase of the selected washing process to be carried out.

The microprocessor means 40 subsequently acts so as to recognize and identify the control position reached in the above described way by said rotating compartment selector means 15, as well as all the subsequent control positions which will in that way be reached by said rotating compartment selector means 15, by detecting the closed state of the corresponding micro-switch and identifying it in the way that is further described hereinafter.

Figure 5:
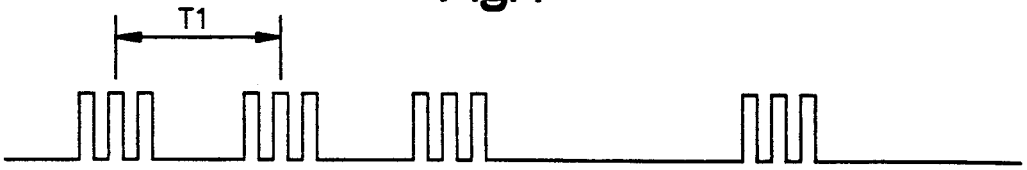
FIG. 5 shows the pattern of the electrical signal generated by the control arrangement according to the invention.

To that purpose, said electronic microprocessor means 40 is set to detect, whenever one among said micro-switches is closed, the presence of the voltage of the electrical conductor means 46, said voltage being also detected through the respective resistive element 48–51 connected in parallel with the respective operational component part 42–45 of the washing machine which is energized by the closure of said micro-switch in the case that said operational component part is not included in the circuit, and said voltage detection occurs in the form of an electrical square-wave signal as shown in FIG. 5 which is generated by an appropriate square-wave generator circuit (not shown), said signal raising to a high level (logic state "1") in the presence of the positive half-wave of the voltage and sinking to a low level (logic state "0") at the zero-crossing of the positive half-wave and in the presence of the negative half-wave of the voltage.

Furthermore, said electronic microprocessor means 40 also acts to count the time $t_1$ elapsing between the detection of an electrical square-wave signal and the immediately next one, and corresponding to the displacement of the rotating compartment selector means 15 from one of its control positions to the immediately next one, the corresponding micro-switches being caused to close upon reaching of these control positions by said rotating compartment selector means 15.

Owing to the fact that said rotating compartment selector means 15 is rotatably driven into its various control positions at a steady speed rate by the corresponding synchronous motor or the program sequence/timer control device (which is also driven by a synchronous motor) or some other similar device of the machine, said rotational movement coming to a standstill whenever a new control position-is reached for which the corresponding micro-switch is therefore operated and caused to close, and owing also to the fact that the value of all time periods elapsing between the occurrence of each electrical square-wave signal and the immediately next one is duly stored in advance in said electronic microprocessor means 40, it ensues that the measurement of these time periods by said microprocessor means enables each corresponding control position of said rotating compartment selector means to be instantaneously and automatically identified by the same microprocessor means.

In order to identify the first control position (i.e., the control position referred to with the letter "a" in this example) of the rotating compartment selector means 15, so as to be able to identify without errors also the subsequent control positions b, c and d of the same selector means, the microprocessor means 40 acts to measure the time elapsing between the actuation to close the micro-switch 20 and the actuation to close the micro-switch 17, as brought about by the rotary displacement of said rotating compartment selector means 15 from the first of said micro-switches to the other one performed by the action of the driving synchronous motor or the program sequence/timer control device in the rotation direction A only, said time being longer than all remaining times since the angular distance from the control position d to the control position a in said rotation direction A of said synchronous motor or program sequence/timer control device is greater than the angular distance from said control position a and each one of the next control positions b, c and d.

The control arrangement achieved in the above described way, due to its ability to identify each one of the control positions of the rotating compartment selector means 15 according to the afore-described procedure, is capable of ensuring, in a simple and reliable way, fully automatic progress control and monitoring of all phases of any washing process as may be selected by the user in washing machines provided with microprocessor or any other similar electronic control device.

Furthermore, for each control position of said rotating compartment selector means, this control arrangement according to the invention enables also at least an operational component part of the machine to be energized or switched on, thereby simplifying and rationalizing both the electrical circuitry and the operation of any washing machine equipped therewith.

We claim:

1. A control arrangement for washing machines, in particular clothes washing machines or combination clothes washing and drying machines having a wash tub, a detergent dispenser means provided with a plurality of separate compartments for containing various wash products and rinse aids to be added into the wash tub, a rotating compartment selector means, and driving means to displace the selector into various operational positions so as to enable in-flowing supply water to selectively flow through each one of said dispenser compartments into the wash tub, said clothes washing machine also having a plurality of operational component parts that are adapted to be energized and de-energized under the control of a electronic microprocessor means for controlling sequences of selected washing steps, said control arrangement comprising switching means (17, 18, 19, 20) operable by said rotating compartment selector means (15) each associated with a corresponding control position of said rotating compartment selector means, and electrical circuit elements (48, 49, 50, 51) connected to respective operational component parts and respective switching means (17, 18, 19, 20), wherein at least one of said operational component parts (42, 43, 44, 45) is associated with a respective one of the switching means and its corresponding circuit element so as to be selectively switchable on and off by said microprocessor means (40).

2. A control arrangement according to claim 1, characterized in that said electrical circuit elements (48, 49, 50, 51) comprise at least a respective resistive element having a high ohmic value, which is connected in parallel with the corresponding operational component part (42, 43, 44, 45) of the washing machine.

3. A control arrangement according to claim 2, characterized in that each control position reached by said rotating compartment selector means (15) is detected by said microprocessor means (40) through the measurement of the time ($t_1$) elapsing between the detection of an electrical square-wave signal generated by a specially provided electronic circuit and corresponding to such a control position and an immediately preceding signal corresponding to an immediately preceding position of said rotating compartment selector switch (15).

* * * * *